US012270193B2

(12) United States Patent
Berdichevsky

(10) Patent No.: US 12,270,193 B2
(45) **Date of Patent: *Apr. 8, 2025**

(54) ENGINEERED BEAM WITH ADJUSTABLE ANGLE CONNECTION

(71) Applicant: Stanislav Berdichevsky, Wayland, MA (US)

(72) Inventor: Stanislav Berdichevsky, Wayland, MA (US)

( * ) Notice: Subject to any disclaimer, the term of this patent is extended or adjusted under 35 U.S.C. 154(b) by 234 days.

This patent is subject to a terminal disclaimer.

(21) Appl. No.: 18/047,873

(22) Filed: Oct. 19, 2022

(65) Prior Publication Data

US 2023/0146389 A1 May 11, 2023

Related U.S. Application Data

(63) Continuation of application No. 16/867,637, filed on May 6, 2020, now Pat. No. 11,512,461.

(60) Provisional application No. 62/843,679, filed on May 6, 2019.

(51) Int. Cl.
*E04B 1/24* (2006.01)
*E04B 1/19* (2006.01)

(52) U.S. Cl.
CPC ..... *E04B 1/2403* (2013.01); *E04B 2001/193* (2013.01); *E04B 2001/1966* (2013.01); *E04B 2001/2406* (2013.01); *E04B 2001/2409* (2013.01); *E04B 2001/2427* (2013.01); *E04B 2001/2457* (2013.01)

(58) Field of Classification Search
CPC ..... E04B 1/2403; E04B 2001/2457; E04B 2004/2409; E04B 2001/2427; E04B 2001/2406; E04B 2001/193; E04B 2001/1966; Y10T 403/32327; Y10T 403/32336; Y10T 403/32361; F16C 11/045
See application file for complete search history.

(56) References Cited

U.S. PATENT DOCUMENTS 3,146,864 A ‡ 9/1964 Nystrom ..... E04B 1/24 403/231
3,423,898 A ‡ 1/1969 Coloney ..... E04B 7/063 D25/17
3,950,109 A ‡ 4/1976 Smith ..... E04C 3/17 403/403
4,189,247 A ‡ 2/1980 Burwall ..... F16B 7/00 182/186.7

(Continued)

FOREIGN PATENT DOCUMENTS

GB 2479551 A ‡ 10/2011

*Primary Examiner* — Theodore V Adamos
(74) *Attorney, Agent, or Firm* — Greenberg Traurig, LLP; Roman Fayerberg; Joshua I. Rudawitz

(57) ABSTRACT

A system for providing an angled construction or bent beam construction. Such system may include a first beam comprising a first elongated beam segment having a first interlocking joint portion at one end, and a second beam comprising a second elongated beam segment having a second interlocking joint at one end, wherein the first interlocking joint portion is configured to rotatably couple to the second interlocking joint to form a rotatable joint such that the angle between the first beam and the second beam is adjustable.

20 Claims, 15 Drawing Sheets

(56) References Cited

U.S. PATENT DOCUMENTS 4,280,307 A ‡ 7/1981 Griffin ..... E04B 1/61 52/92.1
4,335,555 A ‡ 6/1982 Southerland ..... E04B 7/02 52/713
4,666,327 A ‡ 5/1987 Su ..... E06C 1/32 16/324
4,697,305 A ‡ 10/1987 Boothe ..... E06C 1/32 16/349
4,713,923 A ‡ 12/1987 Sielaff ..... F16B 9/052 52/713
4,831,807 A ‡ 5/1989 Bolt ..... E04B 1/3445 403/100
5,094,059 A ‡ 3/1992 Ganescu ..... E04B 1/3441 16/371
5,440,977 A ‡ 8/1995 Poutanen ..... E04C 3/17 144/353
5,661,942 A ‡ 9/1997 Palmer ..... E04H 15/48 135/156
5,711,131 A ‡ 1/1998 Thomas ..... E04C 3/08 403/170
6,047,512 A ‡ 4/2000 Wendt ..... E04B 9/30 52/506.07
6,430,887 B1 ‡ 8/2002 Daudet ..... E04B 1/3441 16/223
6,565,156 B1 ‡ 5/2003 Yamashita ..... A47C 1/026 297/354.12
7,131,243 B1 ‡ 11/2006 Sirowatka ..... E04C 3/005 52/604
7,647,734 B2 ‡ 1/2010 Sarkisian ..... E04H 9/02 52/167.3
7,694,635 B2 ‡ 4/2010 Bernheimer ..... A47B 13/02 108/153.1
8,869,484 B2 ‡ 10/2014 Gulbrandsen ..... E04B 9/068 52/506.07
9,163,428 B1 ‡ 10/2015 Fare ..... E05B 17/10
10,557,227 B2 ‡ 2/2020 Felsenthal ..... D06F 57/08
10,745,919 B1 ‡ 8/2020 Houston ..... E04B 5/10
11,512,461 B2 * 11/2022 Berdichevsky ..... E04B 1/2604
2003/0031077 A1 ‡ 2/2003 Emms ..... E04C 3/40 365/230.03
2003/0177608 A1 ‡ 9/2003 Hozie ..... E01D 15/14 16/367
2003/0233805 A1 ‡ 12/2003 Horne ..... E04C 3/17 52/712
2005/0268434 A1 * 12/2005 Burbrink ..... E06C 1/32 16/324
2006/0185311 A1 ‡ 8/2006 Attalla ..... E04B 7/045 52/639
2007/0292204 A1 ‡ 12/2007 Hackney ..... E04B 1/10 403/93
2011/0142591 A1 ‡ 6/2011 Kempf ..... E04B 1/344 414/815
2013/0167465 A1 ‡ 7/2013 Santeramo ..... E04B 9/10 52/506.07
2013/0343806 A1 ‡ 12/2013 Ng ..... F21V 21/26 403/120
2016/0222671 A1 ‡ 8/2016 Whitney ..... E04F 10/0651
2018/0044938 A1 ‡ 2/2018 Warner ..... E04H 15/46
2019/0093367 A1 * 3/2019 Vanker ..... E04F 11/02
2020/0108904 A1 ‡ 4/2020 Cysewski ..... E04B 1/28
2020/0354948 A1 11/2020 Berdichevsky

* cited by examiner
‡ imported from a related application

ENGINEERED BEAM WITH ADJUSTABLE ANGLE CONNECTION

CROSS-REFERENCE TO RELATED APPLICATIONS

This application is a Continuation Patent Application of U.S. application Ser. No. 16/867,637, filed May 6, 2020, which claims the benefit of and priority to U.S. Provisional Application No. 62/843,679 filed May 6, 2019, each of which are incorporated herein by reference in their entireties.

FIELD OF THE DISCLOSURE

The present disclosure relates to design, construction, and maintenance of building structures. In particular, the present disclosure relates to interlocking structural elements configured for use in various roof and stair constructions.

BACKGROUND

Generally, in construction, a beam is a structural element that primarily bends to resist loads. The loads applied to the beam result in reaction forces at support points of the beam. The forces applied to the beam produce bending moments and shear forces as internal factors.

Some architectural designs are constructed with beams with a bent axis, so called bent beams. Such beams can be used to support hip roofs, cathedral ceilings, roofs above dormers, stair landing/stringers, horizontally bent purlins and some other elements. The common solution in these situations is to use bent or curved steel beams to achieve required architectural shape of the structure. However, the bent metal beams are expensive and not easily obtainable. The full moment connection of the bent steel beam is produced in the metal shop and requires precise measuring and welding. In wood constructions, bent beams are not commonly used because of the complexity to create a moment connection in the wood beams that will be able to resist the load without failure. For example, the common solution to building a cathedral ceiling is to install a ridge beam supported at two ends with posts. However, ridge beams are sometimes undesirable since they require an additional support which can interfere with interior space or be not possible at all.

Accordingly, there is a need for a beam design and system that would provide an easy and economical way to create a moment connection with an adjustable angle between the segments of a bent beam.

SUMMARY

There is a need for improvements for how certain architectural structures are constructed and supported. Specifically, there is a need in wood construction to provide a moment connection of the straight-beam segments, provide the ability to connect these segments at variable angles which can be easily adjusted in the field, and make this type construction effective and doable with or without special tools. The present disclosure is directed toward further solutions to address this need, in addition to having other desirable characteristics. Specifically, the present disclosure provides engineered beams that are configured to be interconnected with one another at any combination of angles.

In some embodiments, the present disclosure provides a system for providing an angled construction, the system comprising a first beam comprising a first elongated beam segment having a first interlocking joint portion at one end, and a second beam comprising a second elongated beam segment having a second interlocking joint at one end, wherein the first interlocking joint portion is configured to rotatably couple to the second interlocking joint to form a rotatable joint such that the angle between the first beam and the second beam is adjustable. In some embodiments, the first interlocking joint portion comprises at least one protrusion and at least one recess, and the second interlocking joint portion comprises recess corresponding to each of the at least one protrusion of the first interlocking joint portion and protrusions corresponding to each of the at least one recess of the first interlocking joint portion. In some embodiments, the rotatable joint is configured to be rotated to a desired angle. In some embodiments, the rotatable joint is configured to fixedly attach the first elongated beam segment and the second elongated beam segment by at least one of an adhesive, screw, nail, pin, and bolt. In some embodiments, the first interlocking joint portion and the second interlocking joint portion have a circular shape to enable the first beam and the second beam to be rotated relative to one another to set adjust the angle between the first beam and the second beam. In some embodiments, a diameter of the first interlocking joint portion and the second interlocking portion are greater than a width of the first elongated beam segment and the second elongated beam segment.

In some embodiments, the present disclosure provides a method for providing an angled construction, the method comprising removably coupling a first beam to a second beam to create a rotatable joint, the first beam comprising a first elongated beam segment having a first interlocking joint portion at one end and the second beam comprising a second elongated beam segment having a second interlocking joint portion at one end, wherein the rotatable joint is formed by coupling the first interlocking joint portion and the second interlocking joint portion; rotating at least one of the first elongated beam segment relative to the second elongated beam segment about the rotatable joint to achieve a desired angle between the first elongated beam segment and the second elongated beam segment; and fixedly attaching the first elongated beam segment and the second elongated beam segment at the rotatable joint. In some embodiments, the method further comprises removing excess material from at least a portion of the first interlocking joint portion and second interlocking joint to form a point. In some embodiments, the first elongated beam segment and the second elongated beam segment are fixedly attached by at least one of an adhesive, screw, nail, pin, and bolt. In some embodiments, the method further comprises fixedly attaching uncoupled ends of the first elongated beam segment and the second elongated beam segment to opposing vertical wall structures to form the angled construction.

In some embodiments, the present disclosure provides a beam comprising an elongated beam segment having an interlocking joint portion at a first end and a flat portion at a second end, the interlocking join portion having at least one protrusion and at least one recess. In some embodiments, the at least one protrusion has a circular cross-section along its longitudinal axis; and the at least one protrusion is configured to be attached within at least one recess within a second elongated beam segment, such that the longitudinal axes of the at least one protrusion of the beam is aligned in parallel with at least one protrusion of the second elongated beam segment. In some embodiments, the at least one protrusion has a diameter greater than a width of the elongated beam segment. In some embodiments, the thickness of the at least one protrusion is less than the thickness of the elongated beam segment to allow interdigitation with a protrusion of an opposite beam. In some embodiments, the interlocking join portion comprises one protrusion arranged to form a part of a sidewall of the beam. In some embodiments, the interlocking joint portion comprises multiple protrusions. In some embodiments, the protrusions of the beam are arranged to form opposite sidewalls of the beam. In some embodiments, the diameter of the at least one protrusion is greater than the thickness of the elongated beam segment. In some embodiments, the beam has a layered structure alternating an elongated beam segment layer having a layer of the elongated beam segment of the beam ending with the at least one recess and a protrusion layer having the layer of the elongated beam segment of the beam extended with the protrusion, wherein the elongated beam segment layer and the protrusion layer are rigidly attached to each other such that the layer of the elongated beam segment of the elongated beam segment layer is aligned with the layer of the elongated beam segment of the protrusion layer. In some embodiments, the first interlocking joint portion comprises at least one protrusion and at least one recess; and the second interlocking joint portion comprises recess corresponding to each of the at least one protrusion of the first interlocking joint portion and protrusions corresponding to each of the at least one recess of the first interlocking joint portion.

BRIEF DESCRIPTION OF THE FIGURES

These and other characteristics of the present disclosure will be more fully understood by reference to the following detailed description in conjunction with the attached drawings, in which.

DETAILED DESCRIPTION

Figure 1A:
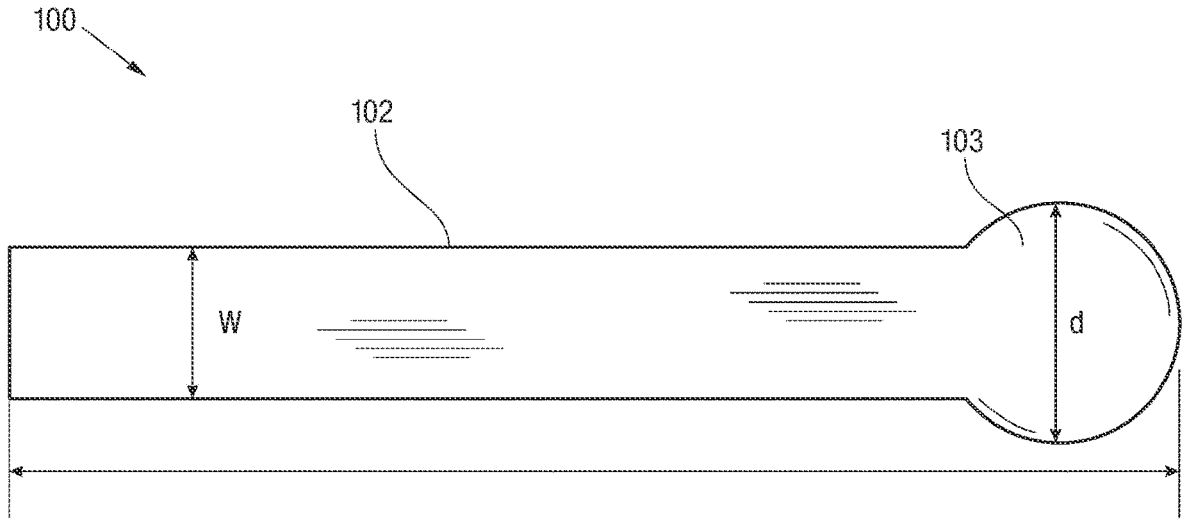
FIGS. 1A, 1B, 1C, 1D and 1E show beam joints in accordance with the present disclosure.

An illustrative embodiment of the present disclosure relates to beams that are configured with interlocking joints that enable the beams to be coupled together at adjustable angles. The beams of the present disclosure can be an engineered wood product, such as, for example, a laminated veneer lumber (LVL) beams with an interlocking joint at one or both ends of the beams. The interlocking joint can be sized and shaped such that two beams can be removably coupled directly to one another, rotated to a create a desired angle at the axis of the two beams, and fixedly attached to one another once the desired angle is achieved. The present beams with the interlocking joints have a structure suitable for civil engineering construction as traditional beams, while having adjustability for producing any combination of angles for a structure.

FIGS. 1A-7, wherein like parts are designated by like reference numerals throughout, illustrate some embodiments of improved operation for beam construction, according to the present disclosure. Although the present disclosure will be described with reference to the example embodiment or embodiments illustrated in the figures, it should be understood that many alternative forms can embody the present disclosure. Different ways to alter the parameters of the embodiment(s) disclosed, such as the size, shape, or type of elements or materials can be employed, in a manner still in keeping with the spirit and scope of the present disclosure.

Figure 1B:
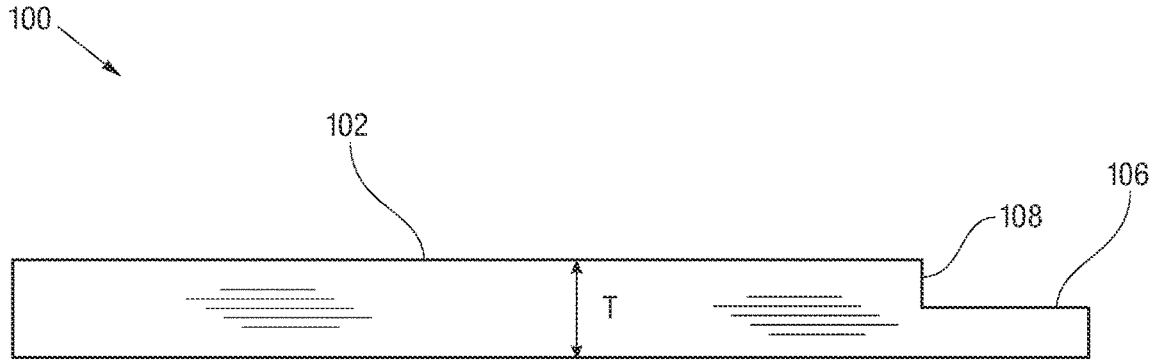

Referring to FIGS. 1A-IE, examples of a beam 100 in accordance with the present disclosure are depicted. The dimensions of the beam 100 (and other beams discussed herein) may be referenced in terms of length (L), thickness (T), and width or depth (W), as shown in FIGS. 1A and 1B. In some embodiments, as shown in FIG. 1A, the beam 100 of the present disclosure can include an elongated beam segment 102 and an interlocking joint portion 103. In operation, the interlocking joint portion of one beam is rotatably coupled to the interlocking joint of an opposing beam to form a rotatable joint 104, as shown in FIG. 1D. In this manner, the angle between the beams is adjustable to any desired angle. In some embodiments, the beams of the present disclosure may include an interlocking joint portion 103 at both ends of the elongated beam segment 102 to connect more than two beams together.

The elongated beam segment 102 can be an elongated piece suitable for use in construction, similar in shape to a conventional beam used in construction. The beams can be made of LVL, or any other customary material used in constructions (steel, wood, plastic, etc.). The elongated beam segment 102 of the present disclosure may have any cross-sectional shape (rectangular, round, pipe, combined cross section, etc.), and the cross section may vary as a function of the beam length (constant, tapered, etc.).

In some embodiments, the interlocking joint portion 103 can be of a substantially rounded or circular shape (circle or semi-circle or similar), as depicted in FIG. 1A. Although the exemplary examples of the interlocking joint portion 103 provided herein includes a substantially rounded shape, any shape can be utilized, as long as the shape of the interlocking joint portion 103 enables rotation of the beam 100 to various angles, as discussed herein. In some embodiments, the protrusion has a circular or semi-circular shape. The interlocking joint portion 103 can be manufactured from the same material as the elongated beam segment 102 and may be integrally manufactured with the elongated beam segment 102. In some embodiments, the interlocking joint portion 103 may be made of a different material than the elongated beam segment 102. In some embodiments, if not integral with the elongated beam segment 102, the interlocking joint portion 103 can be engaged with the elongated beam segment 102 using any known techniques.

In some embodiments, the interlocking joint portion may be circular with a diameter (d) that increases with the increase in the width of the elongated beam segment. For example, the diameter of the interlocking joint portion can be between 16 and 18 inches for 7.25 inches wide or deep elongated beam segment, between 16 and 18 inches for 7.25 inches wide elongated beam segment, between 17 and 19 inches for 9.5 inches wide elongated beam segment, between 18 and 20 inches for 11.25 inches wide elongated beam segment, between 20 and 22 inches for 14 inches wide elongated beam segment, or about 24 inches for 16 inches wide elongated beam segment. To achieve reasonable flexibility in angles the diameter of the interlocking joint portion can be at least 25% greater than width of the elongated beam segment. In some embodiments, the diameter of the interlocking joint portion can be between 25% and 70% greater than width of the elongated beam segment. In some embodiments, the diameter of the interlocking joint portion can be between 30% and 60% greater than width of the elongated beam segment.

In some embodiments, the interlocking joint portion comprises one or more protrusions and one or more recesses or gaps for receiving one or more protrusions of the opposing beam. For example, some embodiments provide two beams with protrusions and recesses or open portions of the gaps, such that the number of protrusions of one beam matches the number of recesses of opposite beam and vice versa. Because the recess goes through the entire width of the beam, each recess of a beam can be an open or empty portion of the entire gap having a thickness substantially equal to the thickness of the protrusion. For example, if the beam has two protrusions and one gap, the opposite beam has two recesses or gaps and one protrusion. In some embodiments, the protrusions and the gaps of the beam are selected such that the beam of the same design can serve on both sides of the interdigitated arrangement. The embodiment interdigitates two beams by placing a protrusion or protrusions of one beam into a corresponding recess or gap of another beam and rotating the beams to form a desired angle. Next, the beams are locked to each other by applying fasteners or adhesive to protrusions of the beam to lock the beams in the interdigitated arrangement of the desired angle.

Figure 1C:
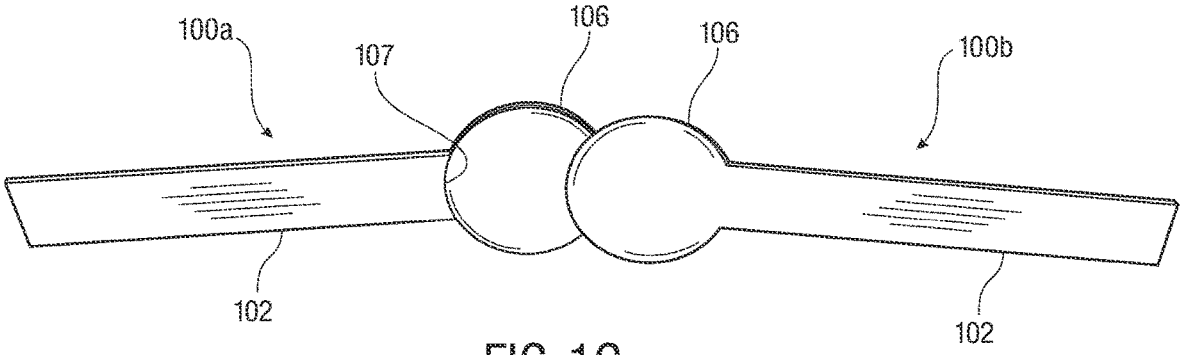
Figure 1D:
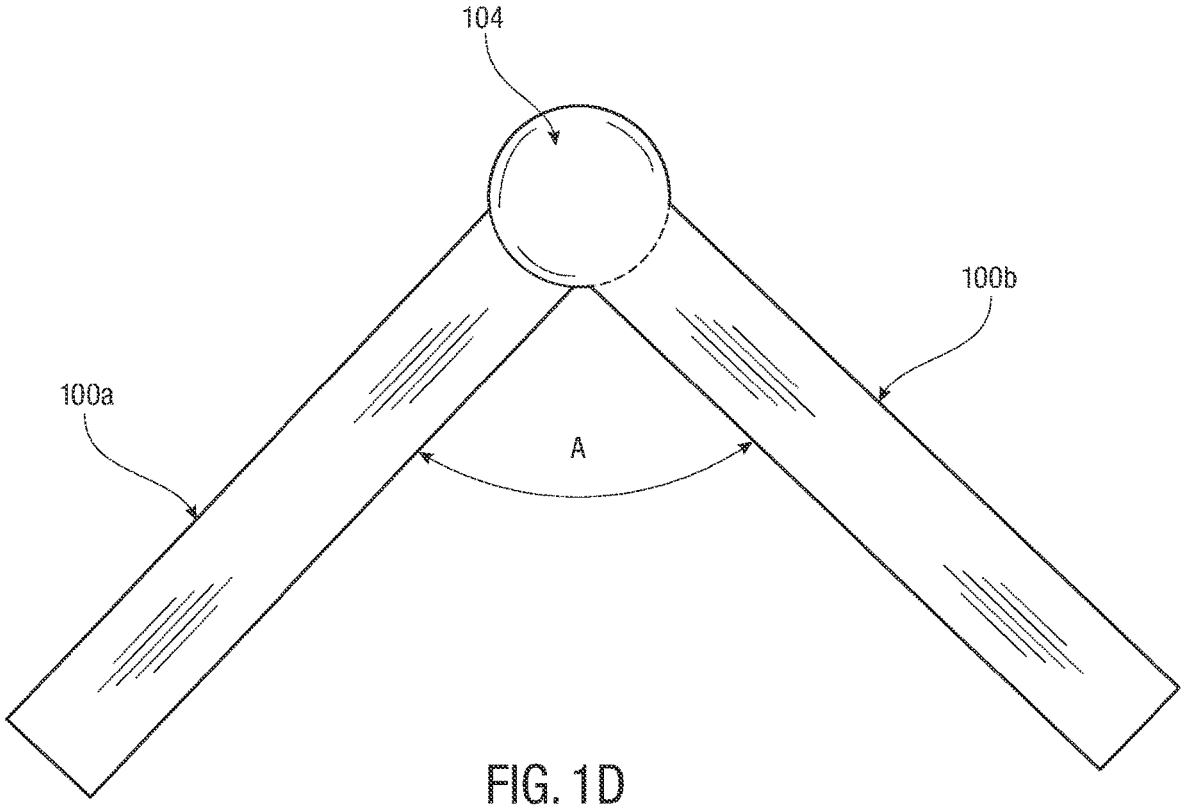

In reference to FIG. 1B and FIG. 1C, in some embodiments, the interlocking joint portion 103 can comprise a protrusion 106 extending from the end of the beam portion 102 and a recess 108 sized and shaped to receive a corresponding protrusion of another beam. In this manner, when the protrusion 106 mates with the recess 108 of an opposing beam 100, a rotatable joint 104 is created. For example, the protrusions 106 are the male components to the female recess 108 of the rotatable joint 104. In some embodiments, the recess may extend into the beam portion.

Figure 3A:
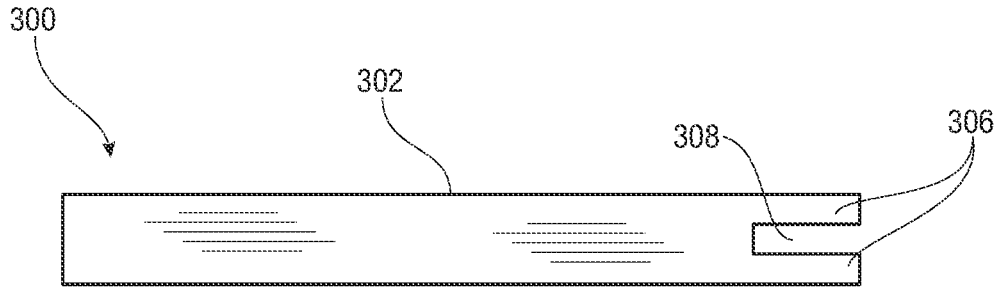
FIGS. 3A, 3B, 3C, and 3D show beam joints in accordance with the present disclosure.

In some embodiments, as shown in FIGS. 1A-1E, the beam can have one protrusion 106. In some embodiments, the thickness of the protrusion 106 is less than the thickness of the beam portion such that the recess 108 is formed to receive a protrusion 106 from another beam 100. For example, the beam 100 can have only a protrusion 106 arranged to form a part of a sidewall of the beam 100, i.e., one sidewall of the protrusion 106 is substantially flush with the sidewall of the elongated beam segment 102, effectively extending a length of the elongated beam segment 102 on that side. The other side of the sidewall of the protrusion 106 can be the face of the recess 108, which is not substantially flush with the elongated beam segment 102. In some embodiments, the beam 100 can have a protrusion 106 arranged at a distance from the sidewall of the beam. The beam with a protrusion 106 that forms a part of a sidewall of the beam makes the beams interchangeable for interdigitated arrangement with other beams of the same configuration. In some embodiments, the beam 100 can have two protrusions of the beam 100 that are arranged to form opposite sidewalls of the beam 100, as shown in FIG. 3A.

Referring to FIG. 1B, atop perspective view of the beam 100 with the interlocking joint portion 103 that includes one protrusion 106 and a corresponding recess 108 is shown. Referring to FIG. 1C, two beams 100 are depicted showing the interlocking joint portions 103 of two beams being interconnected to form the rotatable joint 104. In some embodiments, the protrusion 106 can be a substantially rounded shape. In some embodiments, the recess 108 can include a rounded cutout 107 into the end of the beam portion 102 corresponding to the size and shape of the protrusion 106, as shown in FIG. 1C. In this manner, when two beams are coupled, the circular protrusions 106 can overlap. Although the exemplary examples provided herein include a substantially rounded shape, any combination of shapes can be utilized for the protrusion 106 and the recess 108, as long as the shape of the protrusion enables rotation of the beam 100 to various angles, as discussed herein. In some embodiments, the protrusion has a circular or semi-circular shape.

Figure 1E:
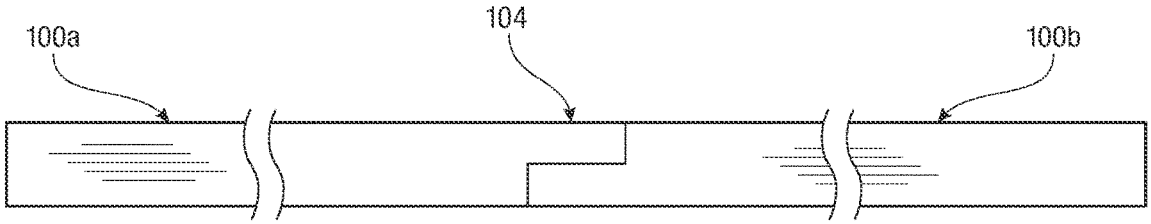

As shown in FIG. 1D, the protrusions 106 of each of the beams 100*a*, 100*b* fill the recesses 108 of the opposing beam to create the rotatable joint 104. The beams 100*a*, 100*b* can be rotated about the interconnected, rotatable joint 104 to form any angle A, as shown in FIG. 1D. Referring to FIG. 1E, an above view of the interlocked the beams 100*a*, 100*b* is depicted.

Figure 2A:
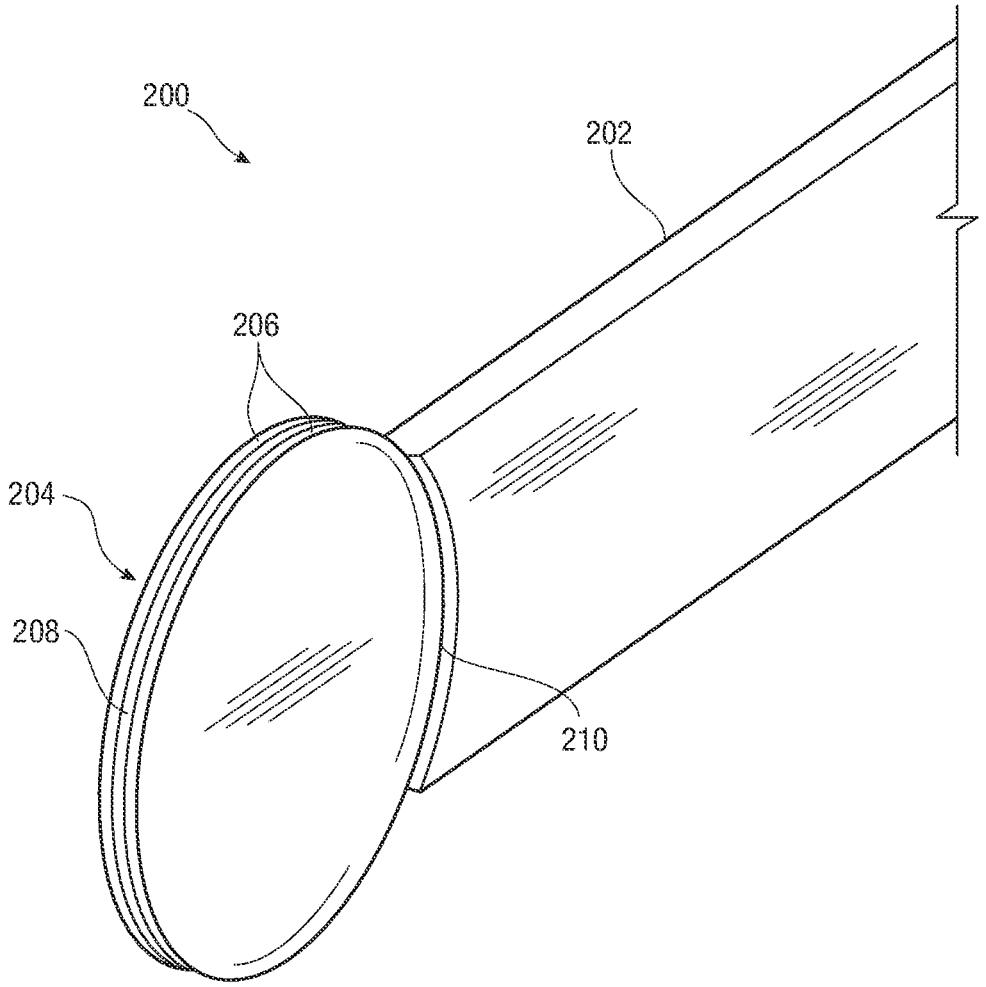
FIGS. 2A, 2B, 2C, and 2D show beam joints in accordance with the present disclosure.
Figure 2B:
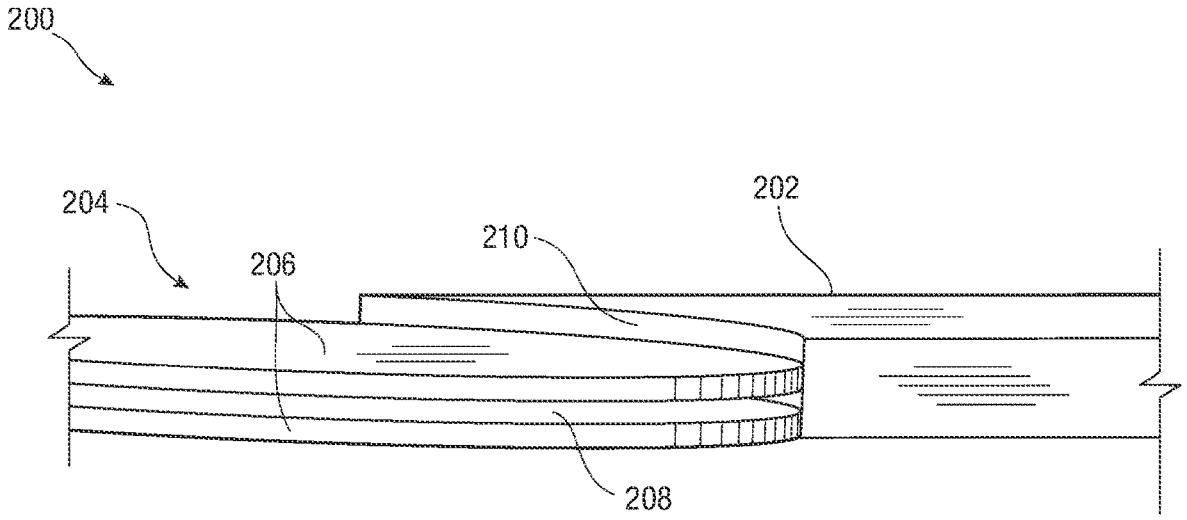

Referring to FIGS. 2A and 2B, exemplary examples of a beam 200 in accordance with the present disclosure are depicted. The beam 200 of the present disclosure includes an elongated beam segment 202 similar in shape to the beams 100 discussed with respect to FIGS. 1A-1D. In some embodiments, the at least one end of the beam portion 202 can include an interlocking joint portion comprising a plurality of protrusions 206 extending from the end of the beam portion 202 and at least one gap 208 located between each pair of protrusions 206. In some embodiments, the at least one gap can extend into the beam portion. In some embodiments, the at least one protrusion 206 and the at least one gap 208 can alternate with one another. The at least one gap 208 can be sized and shaped to correspond to the size and shape of a protrusion 206, such that when two beams 200 are connected to form an interlocking joint 204, the protrusions 206 will mate with the gaps 208 of the opposing beam 200. For example, the protrusions 206 are the male components to the female gaps 208.

In some embodiments, the beam 200 can include more than one protrusion 206 and more than one gap 208. For example, as depicted in FIGS. 2A-2D, the interlocking joint portion can include two protrusions 206 with two corresponding gaps 208, but more protrusions may be provided based on an application. The protrusions 206 can be arranged at a distance to each other, as defined by the corresponding gaps 208, at a spacing that is substantially equal to the thickness of the protrusions 206 themselves so the opposing beams can be interlocked to create a rotatable joint 204. In some embodiments, the beams 200 can be used to construct structures with substantially universal interlocking, rotatable joint 204. Based on the configuration of the protrusions 206 and gaps 208, for example, in a rotatable joint 204, the recesses can include an open-ended or open-faced recess 210 or have no open-ended recesses. In some embodiments, the recess 210 can be defined by a protrusion 206 on one side but nothing on the other side. For example, a recess 210 can be defined by a face of the adjacent protrusion 206 and the cutout shaped from the end of the beam.

Figure 2C:
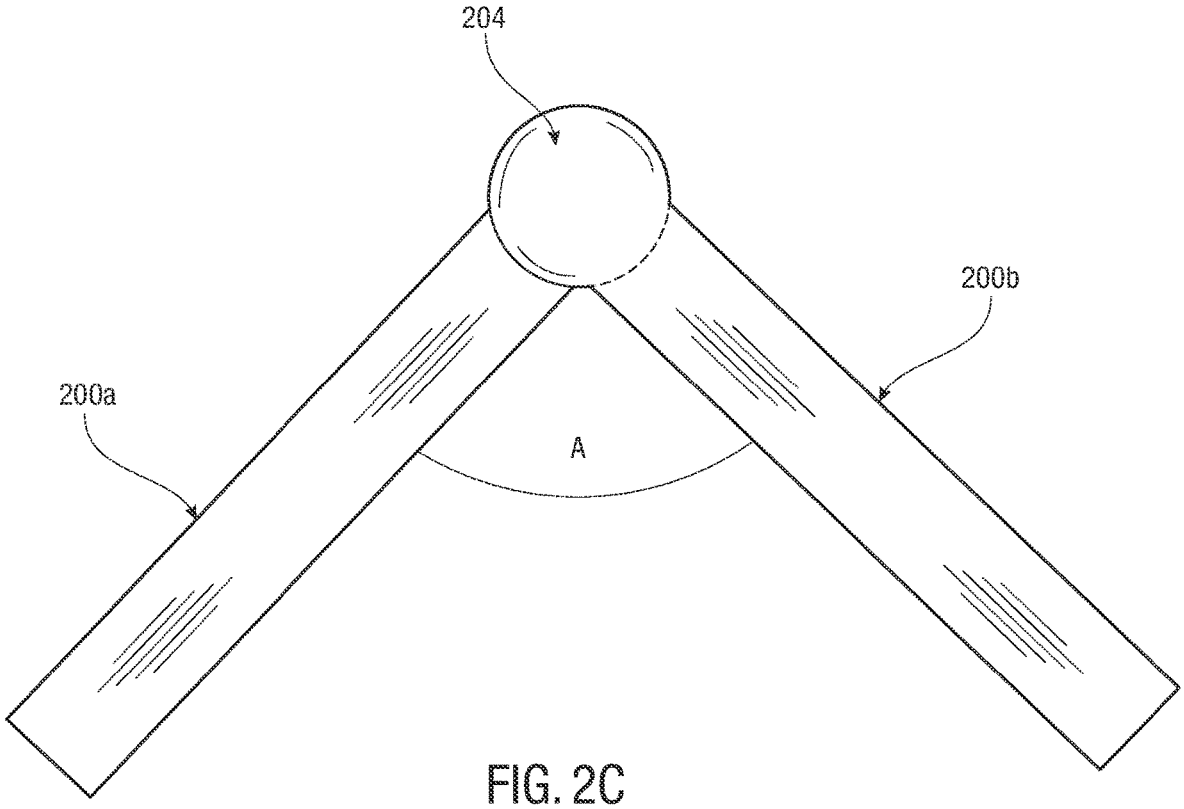
Figure 2D:
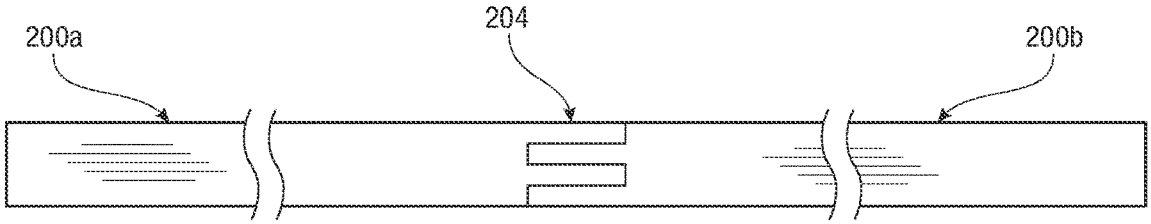

FIGS. 2A-2D depict examples of a beams 200 constructed with substantially universal interlocking joint portions. These beams 200 can be configured to interlock with one another to form a rotatable joint. Referring to FIG. 2C, two beams 200 are depicted showing the interlocking joint portions of two beams being interconnected by interconnecting the protrusions 206 to form a rotatable joint 204. When interlocked, the beams 200*a*, 200*b* can be rotated about the interconnected interlocking joint 204 portions to form any angle A. Referring to FIG. 2D, an above view of the interlocked beams 200*a*, 200*b* is depicted. As shown in FIG. 2D, the protrusions 206 of each of the beams 200*a*, 200*b* fill the gaps 208 and recesses 210 of the opposing beam to create the rotatable joint 204.

In some embodiments, the at least one gap 208, including recess 210 can be formed by subtraction of a circular member from the interlocking joint 204 portion and/or the elongated beam segment 202. To that end, the at least one gap 208 and recess 210 can have a radius, i.e., the radius of subtracted circular member. Also, the at least one gap 208 and recesses 210 can have an indication of a depth of penetration of a circular protrusion 208 to insert into the gaps 208/recess 210 and form substantially flush to the end of the elongated beam segment 202. In some embodiments, the radius of the gap 208 is less or equal the radius of the protrusions 206.

In some embodiments, the protrusions 206 can be sized and shaped to completely fill the void created by the at least one gap 208 and recess 210, along the width of the protrusions 206, to improve structural integrity of the beam. To achieve this, in some embodiments, a radius/diameter of the protrusions 206 can be in a predetermined geometric relationship (predetermined size and shape) with the radius/diameter and/or the depth of the at least one gap 208 and recess 210. In this manner, the opposing beams can mesh together to create a uniform rotatable joint. In some embodiments, the combination of two beams coupled together about a joint 204 can create a structure unified along a shared plane, as depicted in FIG. 2D, such that the beams 200*a*, 200*b* are flush with one another.

In some embodiments, the dimensions of the elongated beam segment 202, the protrusions 206, and respective gaps 208 or recess 210 can vary based on design and application for the beams 200. In some embodiments, the length of the elongated beam segment 202 can be significantly longer than a diameter of the protrusions 206, gaps 208, and recess 210. In some embodiments, the thickness of the combined protrusions 206, gaps 208, and recess 210 can be less than or equal to the thickness of the elongated beam segment 202 to allow interdigitation with a protrusion 206 of an opposite beam. For example, the thickness of the combined protrusions 206, gaps 208, and recess 210 can be substantially identical to the thickness of the elongated beam segment 202. In some embodiments, the thickness of the at least one protrusion is a fraction multiple of the thickness of the elongated beam segment 202 to allow interdigitation.

In some embodiments, the opening of the gaps 208 can be substantially equal to or less than the thickness of the protrusions 206. For example, the gaps 208 can be less than the thickness of the protrusions 206 to allow sufficient space for adding adhesive locking the beams together. For example, for 3.5" thick×11.875" wide LVL, each the protrusions 206 can be approximately 0.875" inches with the opening of the gaps 208 being 0.840" inches. This difference in thickness of the protrusion 206 and the gap 208 can provide an access margin that is multiple of the width of the elongated beam member 202 to allow interdigitation while also providing sufficient tolerance to accept a protrusion 206 within a gap 208.

Figure 3B:
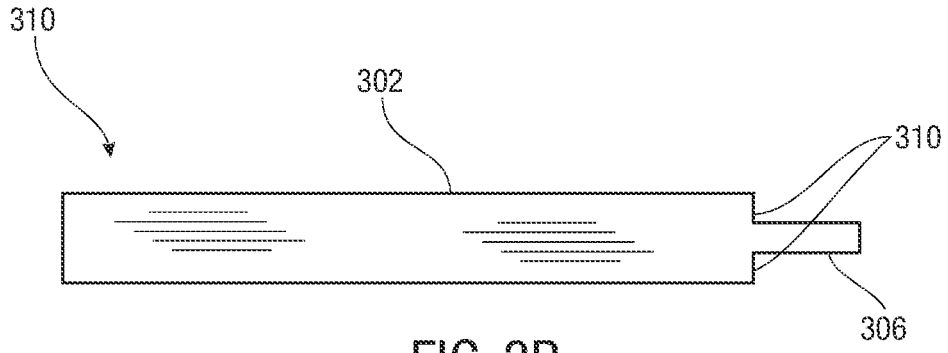
Figure 3C:
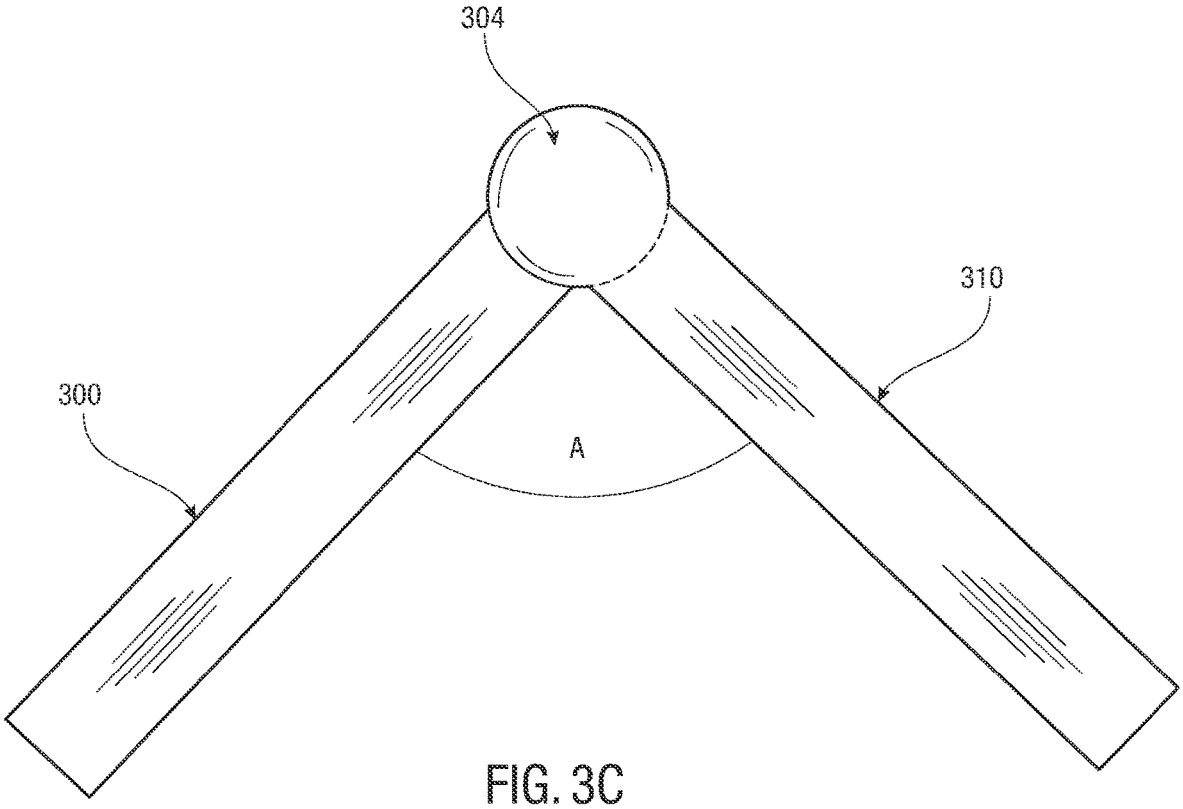
Figure 3D:
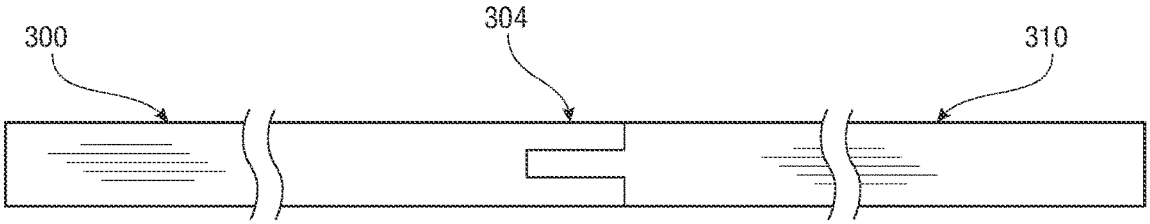
Figure 4A:
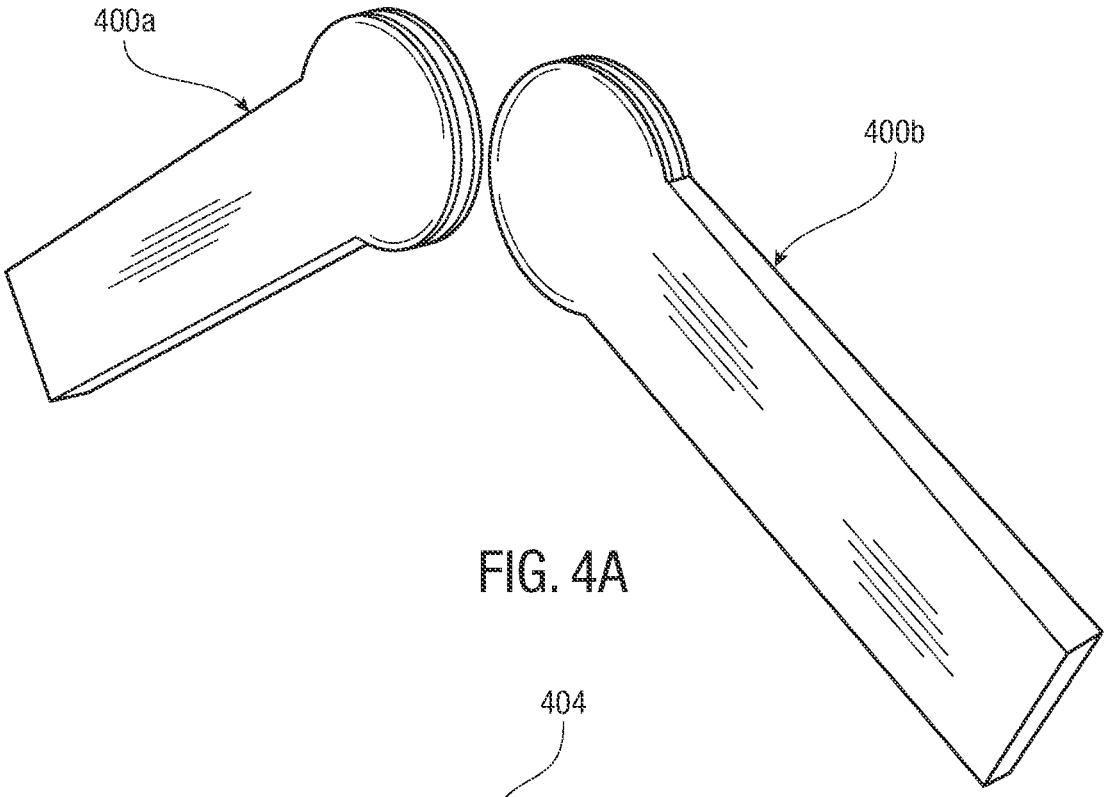
FIGS. 4A, 4B, 4C, 4D, 4E, and 4F depict an exemplary process for coupling beams in accordance with the present disclosure
Figure 4B:
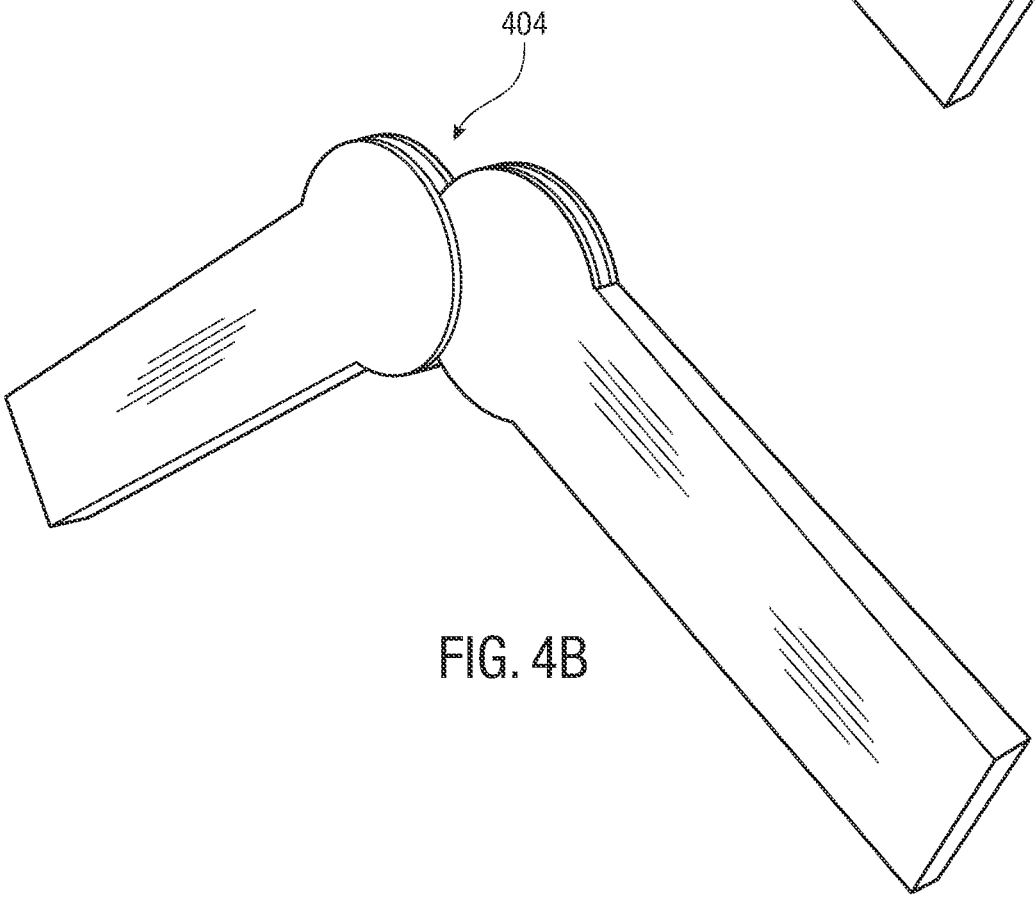
Figure 4C:
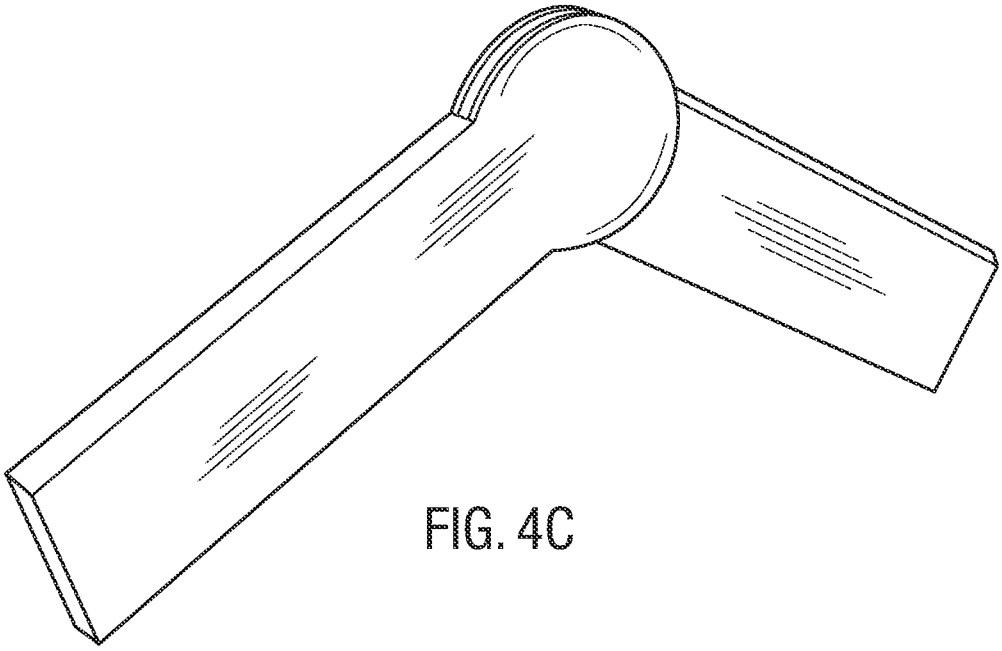
Figure 4D:
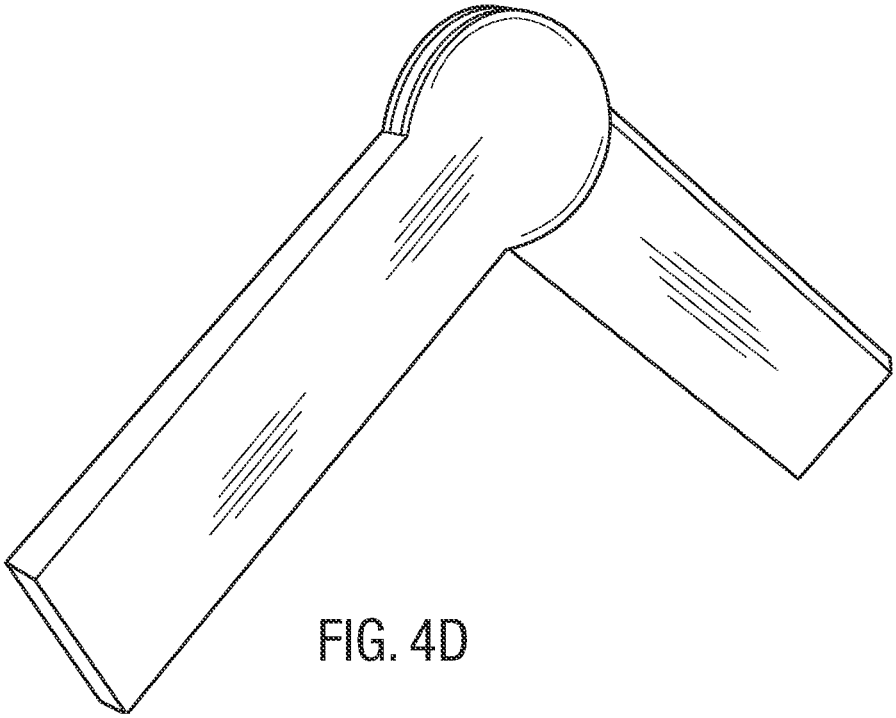
Figure 4E:
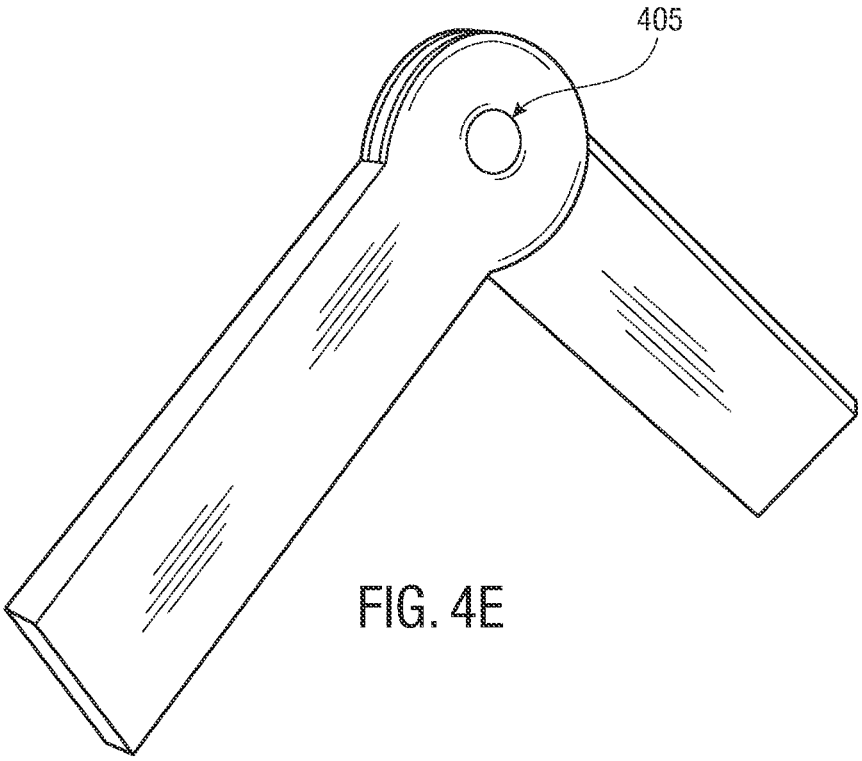
Figure 4F:
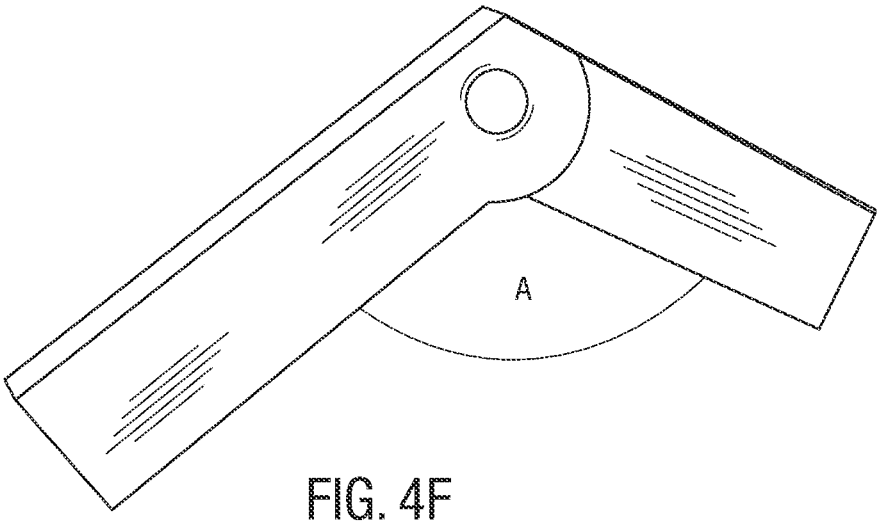

The beams as discussed with respect to FIGS. 1A-2D can be uniform or can include male and female counterparts. For example, a female beam 300 can be combined with a corresponding male beam 301 to form a rotatable joint 304. Referring to FIGS. 3A and 3B a female beam 300 and a male beam 301 are depicted. The interlocking joint portions of these beams 300, 301 can be configured to interlock with a female or male counterpart (i.e., male to female or female to male) to form a joint 304, as depicted in FIGS. 3C and 3D.

Referring to FIGS. 3A and 3B, an exemplary schematic of an interdigitated arrangement of two beams 300, 301 with female and male protrusions are depicted. For example, as shown in FIGS. 3A-3D, the female beam 300 can include two protrusions 306 with a gap 308 therebetween while the male beam 301 can include two recesses 310 with a protrusion 306 therebetween. Similarly, as discussed with respect to FIGS. 1A-2D, a female beam 300 can be rotatably joined with a male beam 301 to form an interlocking, rotatable joint 304. As depicted in FIGS. 3C and 3D, the interlocking joint portions of two separate beams 300, 301 can be removably interjoined with one another to form a rotatable joint and rotated to a desired angle A. In particular, the protrusions 306 of a first beam are inserted into the recesses 310 of another beam 301, and vice versa. The joining of the protrusions 306, gaps 308 and recesses 310 of the opposing beams forms the joint 304 capable of rotating to achieve an infinite number of angles between the two beams 300.

FIGS. 4A-4F show an exemplary method of assembly of the beams of the present disclosure. In some embodiments, the beams 400*a*, 400*b* of the present disclosure (e.g., beams 100, 200, 300, 301) are connected to create a rotatable joint 404 (e.g., joint 104, 204, 304). In some embodiments, after the beams 400*a*, 400*b* are brought together, they can be rotated about the rotatable joint 404 until the appropriate angle is obtained. In some embodiments, the beams 400*a*, 400*b* can be attached together to aid in the rotation of the beams. For example, after the opposing joint portions of the beams are brought to coincidence, the beams 400*a*, 400*b* can be coupled together, while allowing their rotation, using a fastener or a pivot 405, such as a central pin, bolt, nail or a similar fastener. This can enable the rotation of the segments about the axis to achieve certain angles between the beams 400*a*, 400*b* without losing coincidence. The angle A can include any combination of angles that the two beams can rotate between one another. For example, the beams 400*a*, 400*b* can create any angle between a substantially 360-degree angle to a 0-degree angle. The angle A can be calculated by $\alpha=2 \arcsin{*}H/2R$. In some embodiments, the beams may include indicia that can help the user set the angle between the beams. After the desired angle is achieved the beams 400*a*, 400*b* can be fixedly coupled together, for example, via additional nails, bolts, screws, adhesives, etc. In some embodiments, the excess material can be removed, for example, to leave a triangular shape between the top of the beams and leave the remaining parts of the joint 404 fastened together.

In some embodiments, once the appropriate angle is achieved, for example, through rotation of one or both beams 400*a*, 400*b* in different directions, the beams 400*a*, 400*b* can be fixedly coupled together without the addition of supplemental coupling elements (e.g., brackets, braces, etc.). For example, the beams 400*a*, 400*b* can be fixedly attached using any combination of fasteners, including but not limited to adhesives, nails, screws, bolts, brackets etc. Similar, using the joint 404, the beams 400*a*, 400*b* can be locked together in a manner sufficient to resist both the shear forces and bending moments on the beams 400*a*, 400*b*. Additionally, the beams can be coupled together in such a manner that the need for additional intermediate supportive structure, such as a ridge beam, can be avoided. Once the beams are coupled together, the excess materials can be removed from the protrusions.

As noted above, the beams of the present disclosure can be used in various structural applications that require a moment connection between the beams. In other words, the beams of the present disclosure may be utilized in structural applications where the beams are located at an angle to one another, such as for example, in the construction of hip roofs, cathedral ceilings, roofs above dormers, stair landing/stringers, horizontally bent purlins and similar constructions. In some embodiments, the beams of the present disclosure may be used to replace pre-fabricated bent beams. In some embodiments, the beams of the present disclosure can eliminate the need for an additional support.

Figure 5:
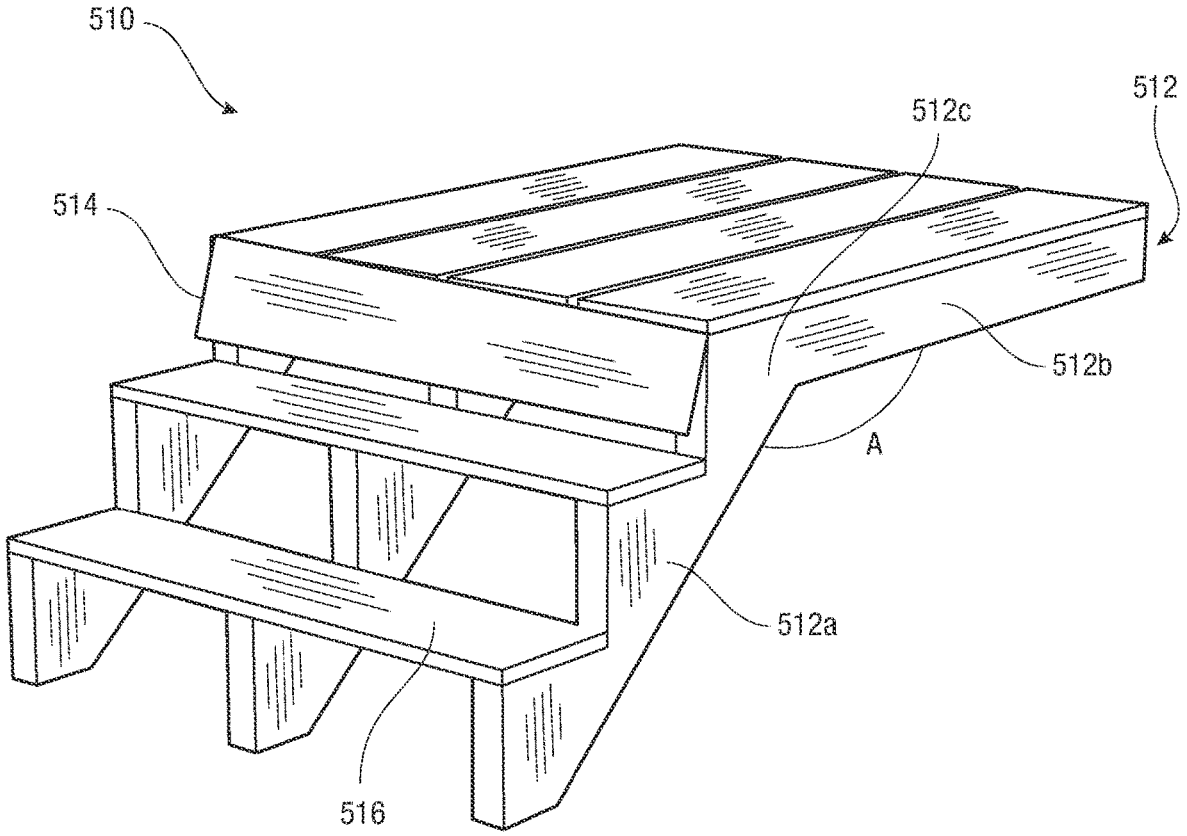
FIG. 5 illustrates an exemplary stair construction using the beams in accordance with the present disclosure.

FIG. 5 provides an exemplary depiction of a stair construction 510 using the beams of the present disclosure is provided. The stair construction 510 can include a cutout stringer 512 with risers 514 and/or threads 516 attached thereto to create a stairway structure. In some embodiments, the cutout stringer 512 can be constructed from two beams (e.g., beams 100, 200, 300, 301) of the present disclosure to create a stairwell landing with a designed angle A. The beam construction of beams 512*a* and 512*b* can be configured to create a joint 512*c*, such that the joint 512*c* is similar in construction to the joints 104, 204, 304 discussed in greater detail herein. In comparison to traditional beams, the joint 512*c* can be formed without an additional support such as a post that would be required with conventional beams.

Figure 6A:
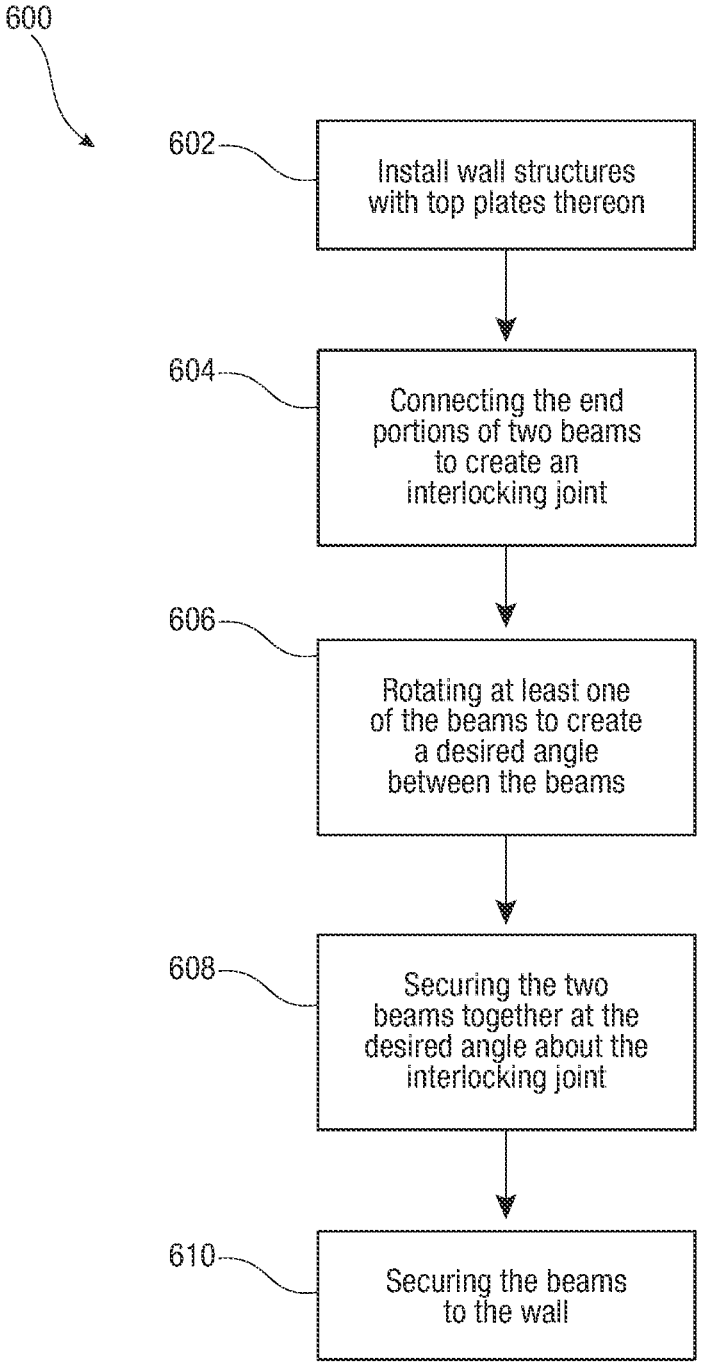
FIG. 6A illustrates an exemplary method for building a roof construction using the beams in accordance with the present disclosure.
Figure 6B:
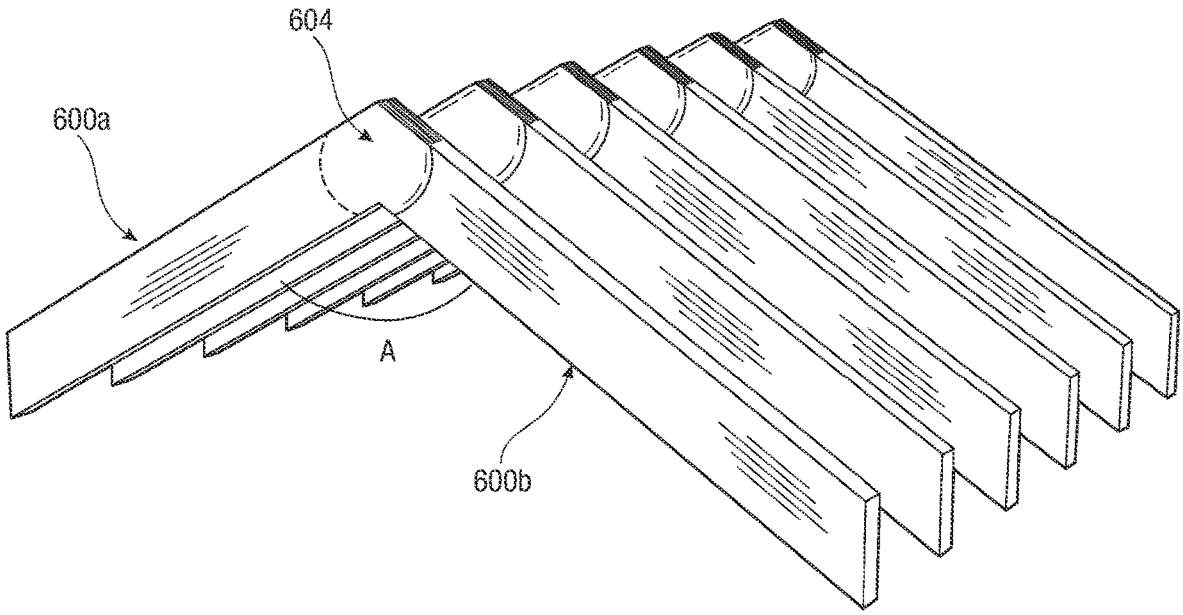
FIG. 6B illustrates an exemplary roof construction using the method of FIG. 6A in accordance with the present disclosure.

Referring to FIG. 6A and FIG. 6B, an exemplary block diagram of a process 600 for building a roof and an illustration of a beam construction resulting from the process 600, respectively, using the beams of the present disclosure is depicted.

In traditional roof construction, the roof construction typically includes a plurality of beams that are positioned at different locations and in different orientations to construct the roof. Roof construction can include cross beams that extend substantially parallel to the ground that are typically supported by vertical wall structures, including top plates, and/or post structures. The construction can also include rafters that are positioned at an angle to define the angle of the overall roof construction. The rafters are typically angled to allow for water, snow, debris run off. To form an angled roof construction, the rafters are affixed, at a first end, to opposing vertical wall structures (i.e., placed on top plates) on opposing sides of a room or a house. The rafters from the opposing sides extend at angle from the wall structures and connect to a ridge beam, which indirectly couples the opposing rafters and acts to provide the support for the rafters. In contrast, the beams of the present disclosure can be coupled together to act as rafters at a predefined angle without the need for a ridge beam.

In reference to FIGS. 6A and 6B, at step 602, walls are installed with top plates installed on the top portions of the walls. At step 604 the end portions of two beams 600*a*, 600*b* (e.g., beams 100, 200, 300, 301) are connected to create an interlocking joint 604 (e.g., joint 104, 204 or 304). At step 606 one or both of the beams can be rotated to create a desired angle between the beams. At step 608 the interlocking joint can be secured together using any combination of adhesive or fasteners and the excess portion of the joint is cut to create a pointed roof angle, as shown for example, in FIG. 6B. At step 610 the beams are secured to the walls, for example, by nailing the ends of the beams to the wall plate. Finally, roof coverings as can be installed over the beams 600*a*, 600*b*. Wide variety of roof coverings can be used, including, without limitation, asphalt, wood, metal, clay, cement and slate, glass and plastic, and plastic liquid coatings. A similar process can be utilized to construct stairs, for example, the stairs shown in FIG. 5.

In some embodiments, the beams 100, 200, 300, 301, can be formed from a single piece of material or can be formed through a layered manufacturing process. The layered structure can be advantageous for composite beam construction that can reduce the cost of the beam without sacrificing its structural integrity. The layered structure can alternate an elongated beam segment layer having a layer of the elongated beam segment of the beam ending with the gap or a cutout for receiving an interlocking joint portion, and an interlocking joint portion layer having the layer of the elongated beam segment of the beam extended with the interlocking joint portion. In some embodiments, the layered structure can include multiple elongated beam segment layers to provide a desired thickness and multiple interlocking joint portion layers to provide a desired layer thickness, which may be the same or different than the thickness of the elongated beam segment layer. During the manufacturing of the beam, the elongated beam segment layer and the protrusion layer are rigidly attached to each other such that the layer of the elongated beam segment of the elongated beam segment layer is aligned with the layer of the elongated beam segment of the protrusion layer.

Figure 7:
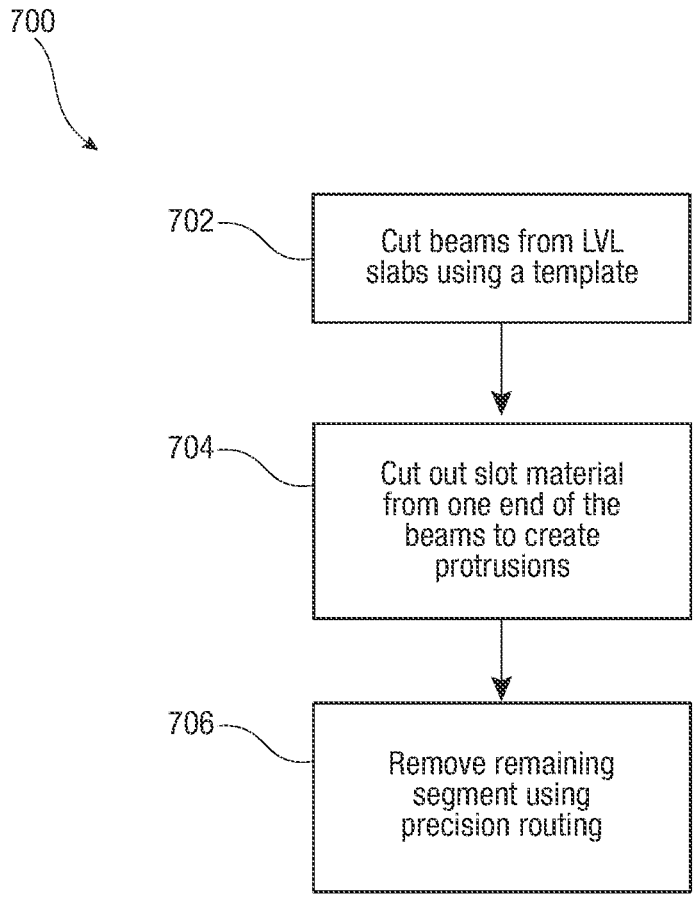
FIG. 7 is an exemplary method for manufacturing the beams in accordance with the present disclosure.

Referring to FIG. 7, an exemplary block diagram of a process 700 for manufacturing a beam in accordance with the present disclosure is depicted. At step 702 the beams (e.g., beams 100, 200, 300 or 301) are cut out from the LVL slabs using a cutting template that leaves minimal. At step 704 most of the slot material can be removed by large diameter saw which ideally leaves a small circle segment unremoved. At step 706 the segment can be precisely removed by routing which is guided by the outside template. Thus, after the process 706 is complete the inside radius of the slot is equal to the outside radius of protrusion. In some instances, a radius of the at least one protrusion can be in a geometric relationship with the radius and the depth of the at least one recess, such that the geometric relationship requires the geometric shape of the at least one protrusion to be changed.

In accordance with some embodiments of the present disclosure, a system for providing an angled construction or bent beam construction is provided. The system includes a first elongated beam segment having a first interlocking joint portion at one end and a second elongated beam segment having a second interlocking joint at one end. The first interlocking joint portion is configured to rotatably couple to the second interlocking joint to form a rotatable joint at a desired angle.

In accordance with aspects of the present disclosure, the first interlocking joint portion includes at least one protrusion and at least one recess and the second interlocking joint portion comprises recesses corresponding to each of the at least one protrusion of the first interlocking joint portion and protrusions corresponding to each of the at least one recess of the first interlocking joint portion. The rotatable joint can be configured to be rotated to the desired angle. The rotatable joint can be configured to fixedly attach the first elongated beam segment and the second elongated beam segment by at least one of an adhesive screw, nail, pin, and bolt. The fixedly attached first elongated beam segment and the second elongated beam segment can form the angled construction.

In accordance with some embodiments of the present disclosure, a method providing an angled construction is provided. The method includes placing a first elongated beam segment having a first interlocking joint portion at one end, removably coupling a second interlocking joint of a second elongated beam segment with the first interlocking joint portion of the first elongated beam segment to form a rotatable joint, rotating at least one of the first elongated beam segment and the second elongated beam segment at the rotatable joint to achieve a desired angle between the first elongated beam segment and the second elongated beam segment, and fixedly attach the first elongated beam segment and the second elongated beam segment at the rotatable joint.

In accordance with aspects of the present disclosure, the method further includes removing excess material from at least a portion of the first interlocking joint portion and second interlocking joint to form a point. The first elongated beam segment and the second elongated beam segment can be fixedly attached by at least one of an adhesive, screw, nail, pin, and bolt. The method can further include fixedly attaching uncoupled ends of the first elongated beam segment and the second elongated beam segment to opposing vertical wall structures to form the angled roof construction.

In accordance with some embodiments of the present disclosure, a beam having a structure suitable for construction is provided. The beam includes an elongated beam segment having an interlocking joint portion at a first end and a flat portion at a second end, the interlocking join portion having at least one protrusion and at least one recess.

In accordance with aspects of the present disclosure, the at least one protrusion has a circular cross-section along its longitudinal axis and the at least one protrusion is configured to be rigidly attached to at least one recess within a second elongated beam segment, such that the longitudinal axes of the at least one protrusion of the beam is aligned in parallel with protrusions of the second elongated beam segment. The at least one protrusion can completely fill the at least one recess along its width and extends outside of the at least one recess. A radius of the at least one protrusion can be in a geometric relationship with the radius and the width of the at least one recess, wherein the geometric relationship can require to be changed. The width of the at least one protrusion can be less than the width of the elongated beam segment to allow interdigitation or interlocking with a protrusion of an opposite beam. The width of the at least one protrusion can be multiple of the width of the elongated beam segment to allow interdigitation. The width of the at least one protrusion can extend with an access margin is multiple of the width of the elongated beam segment to allow interdigitation. The beam can have only one protrusion arranged to form a part of a sidewall of the beam.

In accordance with aspects of the present disclosure, the beam can have multiple protrusions arranged at a distance to each other substantially equal to the width of the protrusion. The two protrusions of the beam can be arranged to form opposite sidewalls of the beam. Only one protrusion of the beam can form a sidewall of the beam, such that the opposite sidewall of the beams ends with the at least one recess. The diameter of the at least one protrusion can equal the thickness of the elongated beam segment. The diameter of the at least one protrusion can be greater than the thickness of the elongated beam segment. The beam has a layered structure alternating an elongated beam segment layer having a layer of the elongated beam segment of the beam ending with the at least one recess and a protrusion layer having the layer of the elongated beam segment of the beam extended with the protrusion, wherein the elongated beam segment layer and the protrusion layer are rigidly attached to each other such that the layer of the elongated beam segment of the elongated beam segment layer is aligned with the layer of the elongated beam segment of the protrusion layer.

As utilized herein, the terms "comprises" and "comprising" are intended to be construed as being inclusive, not exclusive. As utilized herein, the terms "exemplary", "example", and "illustrative", are intended to mean "serving as an example, instance, or illustration" and should not be construed as indicating, or not indicating, a preferred or advantageous configuration relative to other configurations. As utilized herein, the terms "about", "generally", and "approximately" are intended to cover variations that may existing in the upper and lower limits of the ranges of subjective or objective values, such as variations in properties, parameters, sizes, and dimensions. In one non-limiting example, the terms "about", "generally", and "approximately" mean at, or plus 10 percent or less, or minus 10 percent or less. In one non-limiting example, the terms "about", "generally", and "approximately" mean sufficiently close to be deemed by one of skill in the art in the relevant field to be included. As utilized herein, the term "substantially" refers to the complete or nearly complete extend or degree of an action, characteristic, property, state, structure, item, or result, as would be appreciated by one of skill in the art. For example, an object that is "substantially" circular would mean that the object is either completely a circle to mathematically determinable limits, or nearly a circle as would be recognized or understood by one of skill in the art. The exact allowable degree of deviation from absolute completeness may in some instances depend on the specific context. However, in general, the nearness of completion will be so as to have the same overall result as if absolute and total completion were achieved or obtained. The use of "substantially" is equally applicable when utilized in a negative connotation to refer to the complete or near complete lack of an action, characteristic, property, state, structure, item, or result, as would be appreciated by one of skill in the art.

Numerous modifications and alternative embodiments of the present disclosure will be apparent to those skilled in the art in view of the foregoing description. Accordingly, this description is to be construed as illustrative only and is for the purpose of teaching those skilled in the art the best mode for carrying out the present disclosure. Details of the structure may vary substantially without departing from the spirit of the present disclosure, and exclusive use of all modifications that come within the scope of the appended claims is reserved. Within this specification embodiments have been described in a way which enables a clear and concise specification to be written, but it is intended and will be appreciated that embodiments may be variously combined or separated without parting from the disclosure. It is intended that the present disclosure be limited only to the extent required by the appended claims and the applicable rules of law.

It is also to be understood that the following claims are to cover all generic and specific features of the disclosure described herein, and all statements of the scope of the disclosure which, as a matter of language, might be said to fall therebetween.

What is claimed is:

1. A beam comprising an elongated beam segment having, a first end and a second end and a length therebetween and an interlocking joint portion extending from the second end, the interlocking joint portion having at least one protrusion and at least one recess, wherein the elongated beam segment is formed from an engineered wood product having a layered structure comprising:

at least one recess layer having a first length extending for the length of the elongated beam segment; and at least one protrusion layer having a second length greater than the first length to form the interlocking joint portion, wherein the at least one recess layer and the at least one protrusion layer are rigidly attached to each other, and wherein the at least one recess layer and the at least one protrusion layer have multiple layers.

2. The beam of claim 1, wherein the elongated beam segment is configured to be installed as a hip roof, cathedral ceiling, roof above a dormer, stairs, or horizontally bent purlin.

3. The beam of claim 1, wherein:

the at least one protrusion has a circular cross-section along a longitudinal axis of the at least one protrusion; and the at least one protrusion is configured to be attached within at least one recess within a second elongated beam segment, such that the longitudinal axis of the at least one protrusion of the beam is aligned in parallel with at least one protrusion of the second elongated beam segment.

4. The beam of claim 1, wherein the at least one protrusion has a diameter greater than a width of the elongated beam segment.

5. The beam of claim 1, wherein a thickness of the at least one protrusion is less than the thickness of the elongated beam segment to allow interdigitation with a protrusion of an opposite beam.

6. The beam of claim 1, wherein the beam forms a stringer for a staircase.

7. The beam of claim 6, wherein the stringer supports at least one riser to define a step.

8. The beam of claim 6, wherein the staircase is formed without additional supports.

9. A system for providing an angled construction, the system comprising:

a first beam including a first elongated beam segment having a first interlocking joint portion at one end; and a second beam including a second elongated beam segment having a second interlocking joint portion at one end;

wherein the first beam and the second beam are respectively formed from a layered engineered wood product having multiple layers, wherein the multiple layers of the first beam and the second beam form respective protrusions or recesses of a respective first or second interlocking joint portion, and wherein the first interlocking joint portion is configured to rotatably couple to the second interlocking joint portion to form a rotatable joint such that an angle between the first beam and the second beam is adjustable.

10. The system of claim 9, wherein:

the first interlocking joint portion comprises at least one protrusion and at least one recess; and the second interlocking joint portion comprises at least one recess corresponding to each of the at least one protrusion of the first interlocking joint portion and protrusions corresponding to each of the at least one recess of the first interlocking joint portion.

11. The system of claim 9, wherein the first beam and second beam form a stringer for a staircase.

12. The system of claim 11, wherein the stringer supports at least one riser to define a step.

13. The system of claim 11, wherein the staircase is formed without additional supports.

14. The system of claim 9, wherein the rotatable joint is configured to fixedly attach the first elongated beam segment and the second elongated beam segment by at least one of an adhesive, screw, nail, pin, and bolt.

15. A method for providing an angled construction, the method comprising:

removably coupling a first beam to a second beam to create a rotatable joint, the first beam comprising a first elongated beam segment having a first interlocking joint portion at one end and the second beam comprising a second elongated beam segment having a second interlocking joint portion at one end, wherein the rotatable joint is formed by coupling the first interlocking joint portion and the second interlocking joint portion;

rotating at least one of the first elongated beam segment or the second elongated beam segment about the rotatable joint to achieve a desired angle between the first elongated beam segment and the second elongated beam segment; and fixedly attaching the first elongated beam segment and the second elongated beam segment at the rotatable joint, wherein the first beam and the second beam are respectively formed from a layered engineered wood product having multiple layers, wherein the multiple layers of the first beam and the second beam form respective protrusions or recesses of a respective first or second interlocking joint portion.

16. The method of claim 15, wherein the first elongated beam segment and the second elongated beam segment are fixedly attached by at least one of an adhesive, screw, nail, pin, and bolt.

17. The method of claim 15, further comprising, utilizing the fixedly attached first beam and second beam in one or more of a hip roof, cathedral ceiling, roof above a dormer, stairs, or horizontally bent purlin.

18. The method of claim 17, further comprising, forming a stringer for a staircase with the first beam and second beams.

19. The method of claim 18, wherein the stringer supports at least one riser to define a step.

20. The method of claim 18, wherein the staircase is formed without additional supports.

* * * * *